US006251451B1

(12) United States Patent
Zeng

(10) Patent No.: US 6,251,451 B1
(45) Date of Patent: Jun. 26, 2001

(54) MICROWAVABLE PACKAGE

(75) Inventor: Neilson Zeng, Ontario (CA)

(73) Assignee: Graphic Packaging Corporation, Golden, CO (US)

( * ) Notice: Subject to any disclaimer, the term of this patent is extended or adjusted under 35 U.S.C. 154(b) by 0 days.

(21) Appl. No.: 09/242,930

(22) PCT Filed: Aug. 26, 1997

(86) PCT No.: PCT/CA97/00597

§ 371 Date: May 26, 1999

§ 102(e) Date: May 26, 1999

(87) PCT Pub. No.: WO98/08752

PCT Pub. Date: Mar. 5, 1998

Related U.S. Application Data

(63) Continuation of application No. 08/703,098, filed on Aug. 26, 1996, now abandoned.

(51) Int. Cl.[7] ..... B65D 81/34

(52) U.S. Cl. ..... 426/107; 426/234; 219/728; 219/730; 219/759

(58) Field of Search ..... 426/107, 234, 426/243; 219/728–730, 759

(56) References Cited

U.S. PATENT DOCUMENTS 4,542,271 * 9/1985 Tanonis et al. ..... 219/10.55 E
4,904,836 * 2/1990 Turpin et al. ..... 219/10.55 E
4,927,991 * 5/1990 Wendt et al. ..... 219/10.55 E
5,006,684 * 4/1991 Wendt et al. ..... 219/10.55 E
5,038,009 * 8/1991 Babbitt ..... 219/10.55 E
5,117,078 * 5/1992 Beckett ..... 219/10.55 E
5,260,537 * 11/1993 Beckett ..... 219/10.55 E
5,519,195 * 5/1996 Keefer et al. ..... 219/728
5,698,127 * 12/1997 Lai et al. ..... 219/728

FOREIGN PATENT DOCUMENTS

89/04585 * 5/1989 (WO) ..... B65D/81/34
97/11010 * 3/1997 (WO) ..... B65D/81/34
98/08752 * 3/1998 (WO) ..... B65D/81/34

* cited by examiner

*Primary Examiner*—Gabrielle Brouillette
*Assistant Examiner*—Sherry A. Dauerman
(74) *Attorney, Agent, or Firm*—Dorsey & Whitney LLP

(57) ABSTRACT

The disclosed invention provides a microwavable package for a food product. The package comprises a base with an active microwave energy heating element to support the food product. The active microwave heating element comprises energy collecting resonant loops, tuned structures, and transmission lines to collect incident microwave energy and redirect it to other parts of the food product. The microwave package also includes a cover comprising a microwave energy interactive layer including one or more apertures within the cover. The apertures promote localized fields to promote browning of the food product in the local areas around the apertures. The cover may also comprise a susceptor layer that is heated in localized areas around the apertures due to the fields promoted by the apertures and impingement by incident microwaves energy through the apertures, thereby providing localized browning of the food product.

39 Claims, 9 Drawing Sheets

MICROWAVABLE PACKAGE

This application is a continuation of U.S. application Ser. No. 08/703,098, filed Aug. 16, 1996 now abandoned and is the National Phase (371) and PCT/CA97/00597 filed Aug. 26, 1997.

FIELD OF THE INVENTION

The present invention relates to packages for food products and in particular to a microwavable package and an active microwave energy heating element for the same.

BACKGROUND OF THE INVENTION

Microwave ovens have become a principle form of cooking food in a rapid and effective manner and the number of food products available for preparation in a microwave oven is constantly increasing. As the market for microwavable food products has increased, so the sophistication required from such food products has also increased. There is, therefore, a continuing demand to improve the quality of food prepared in a microwave oven and to ensure that when it is presented to the consumer, the food product is attractive and meets the standards normally associated with such food.

Foods that are specially prepared for cooking within a microwave oven are delivered to the consumer in containers that may be used directly within the microwave oven to facilitate preparation, These containers must therefore not only be capable of containing the food product during transport in an effective manner but must also be capable of contributing to the cooking of the food product within the microwave oven and the subsequent presentation of the food product.

As the demand for more sophisticated food products increases, so the demand for effects, particularly appearance, normally associated with food preparation also increases. For example, it is desirable for a food product that includes a pastry shell or lid to have a browned appearance, so that it appears to have been baked. While these effects can be produced in isolation, it becomes more difficult to produce such an effect in combination with a container that can also uniformly heat the food product within a time that offers advantages over conventional cooking techniques.

Typically, the areas in which browning or crisping are required are those on the outer surfaces of the food product. Those areas typically receive the highest proportion of incident microwave radiation and therefore cook or heat the quickest even though the power distribution is very non-uniform over these surfaces. On the other hand, there are areas of the food product that are relatively shielded from incident microwave radiation or exist in a region of a minimum RF field and which therefore require longer cooking periods. If, however, a longer cooking period is provided, the outer surfaces of the food product tend to char and burn, leading to an unacceptable food product.

Various attempts have been made in the past to provide containers that will produce effects normally associated with cooked foods. For example, U.S. Pat. No. 5,322,984 to Habeger, Jr. Et al. and assigned to The James River Corporation suggests a container having heating devices on the bottom wall and possibly the top wall of the container. The heating devices are designed to provide a charring effect normally associated with barbecuing by directing energy normally not incident upon the food product into specific regions. This is purported to produce a localised charring of the food product. Overall, however, such containers have not been successful. The charring effect produced on the food product may be attributed to the high field intensities and associated induced currents that result from the concentration of energy at particular locations. In practice it is found that those induced currents may also cause charring and burning of the container itself.

U.S. Pat. No. 4,927,991 to Wendt et al and assigned to The Pillsbury Company discloses a microwavable package for foodstuffs and in particular pizza. The package includes a tray on which a grid in combination with a susceptor are located. The grid and susceptor combination act together as a microwave energy heating element. The package also includes an aluminum top having apertures provided in it. The apertures allow microwave energy to penetrate the top thereby to heat the foodstuff.

It has also been found that in order to produce the required results for the preparation of the food product, the container must be capable of controlling distribution of energy about the food product, to utilize the energy in the most efficient manner, and at the same time ensure that the food product and the container provide a pleasant and acceptable finished product. Also, the containers must be able to hold the food product securely to avoid damage to the food product during transport. It has been found that in the case of pizza containers, conventional designs have not been adequate resulting in separation between the pizza crust and the toppings during transport.

It is therefore an object of the present invention to provide a novel food product package and active element for the same which obviates or mitigates at least one of the above disadvantages.

SUMMARY OF THE INVENTION

According to one aspect of the present invention there is provided a microwavable package comprising:

a base to support a food product;

an active microwave energy heating element on said base to effect heating of a food product upon impingement by microwave energy; and a cover spaced from said active microwave energy heating element to overlie said food product, said cover including a microwave energy interactive material layer extending substantially over said food product, and a plurality of apertures in said microwave energy interactive material spaced about a peripheral margin of said cover, said apertures being sized to promote localised fields to promote browning of said food product.

In one embodiment, the apertures are in the form of elongate slots arranged in concentric rings. Microwave energy interactive material islands may be located within the slots to enhance further the cooking performance. In this embodiment, the active microwave energy heating element includes a plurality of energy collecting structures, each energy collecting structure having resonant loops. The resonant loops have a perimeter sufficient to limit currents induced therein to below a predetermined level upon impingement by incident microwave energy. The energy collecting structures distribute energy towards a central region of the food product to heat the food product generally uniformly and to inhibit charring of the base. In one form, the active microwave energy heating element further includes tuned structures at spaced locations each of which is located between a pair of the resonant loops.

According to another aspect of the present invention there is provided a microwavable package comprising:

a base to support a food product;

an active microwave energy heating element interposed between said food product and said base to effect heating of said food product upon impingement by microwave energy; and a cover spaced from said active microwave energy heating element to overlie said food product, said cover including a substrate and microwave energy interactive material on said substrate to cover at least a portion of said food product, said substrate extending beyond the peripheral edge of said microwave energy interactive material to isolate electrically said base and said cover.

According to still yet another aspect of the present invention there is provided a packaged food product comprising:

a base to support said food product;

a flexible cover to overlie and conform to said food product; and a flexible wrap to constrain said base and cover and inhibit relative movement therebetween.

According to still yet another aspect of the present invention there is provided an active microwave energy heating element for a microwavable package to heat generally uniformly a food product within said package, said active microwave energy heating element comprising:

a plurality of energy collecting structures, each of said energy collecting structures including resonant loops having a perimeter sufficient to limit currents induced therein to below a predetermined level upon impingement by incident microwave energy; and a plurality of tuned structures at spaced locations and positioned between adjacent resonant loops, said energy collecting and tuned structures distributing energy across said active microwave energy heating element to heat generally uniformly said food product and inhibiting charring of said microwavable package.

In still yet another aspect of the present invention there is provided a microwavable package comprising:

a tray having a base and an active microwave energy heating element on said base to effect heating of a food product on said tray upon impingement by microwave energy; and a plurality of spaced apertures in said tray to permit moisture released from a food product to pass through said tray.

The present invention provides advantages in that the microwavable package design is such to heat generally uniformly the food product while browning the outer periphery of the food product. This design is particularly suited to cooking pizzas.

BRIEF DESCRIPTION OF THE DRAWINGS

Embodiments of the present invention will now be described more fully with reference to the accompanying drawings in which.

DETAILED DESCRIPTION OF THE PREFERRED EMBODIMENTS

Figure 1:
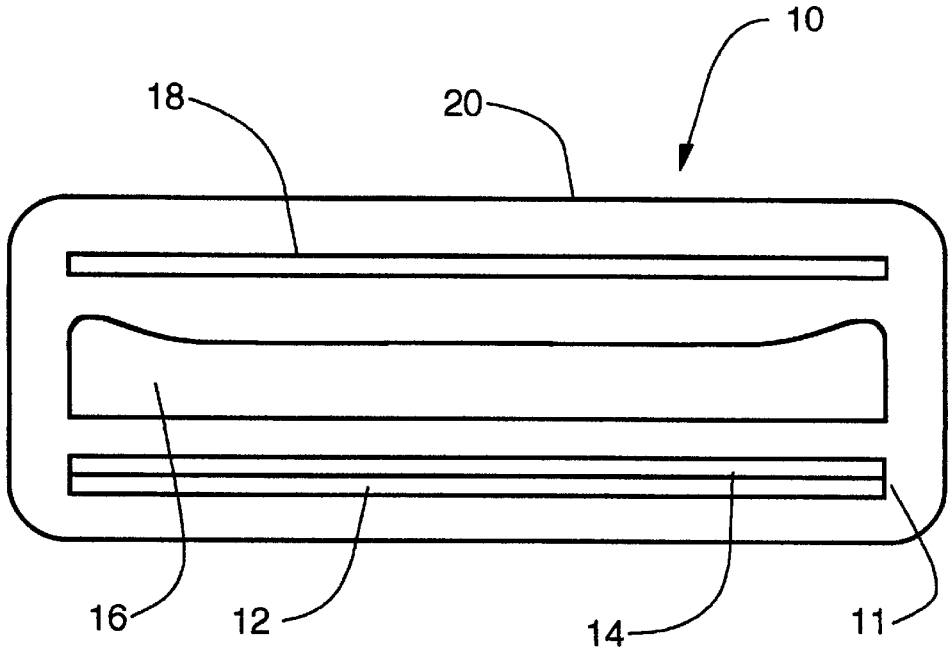
FIG. 1 is an exploded side elevational view of a microwavable package in accordance with the present invention.

Referring now to FIG. 1, a microwavable package for a food product is shown and is generally indicated to by reference numeral 10. The package 10 in this particular example is best suited to contain uncooked pizzas having raw dough crusts.

As can be seen, in this particular example the package 10 includes a tray 11 having a base 12 formed of suitable material such as for example, paperboard. The base is in the form of a circular disc sized to the dimension of the food product to be held in the package 10. The base can of course take other geometric shapes if desired. An active microwave energy heating element 14 is bonded or adhered to one surface of the base 12. The food product, in this case a pizza 16, contacts the microwave energy heating element and is supported by the base 12. A flexible cover 18 overlies the top of the food product 16 and conforms with its surface. The cover 18 can be folded at its periphery to overlie at least part of the sides of the food product. A plastic wrap 20 encompasses the base 12, cover 18 and food product 16 to maintain the base 12 and cover 18 in secure contact with the food product 16 and inhibit relative movement therebetween.

Figure 2:
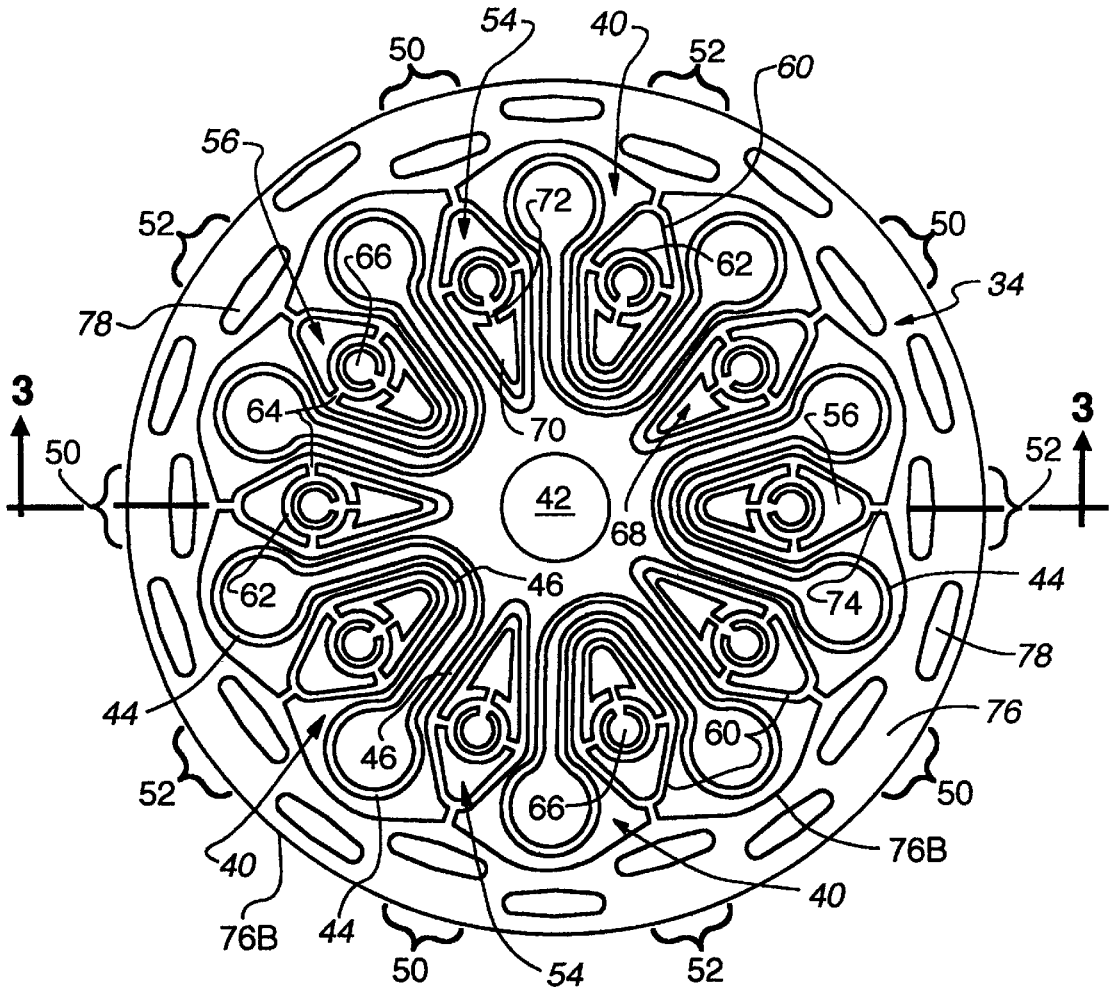
FIG. 2 is a top plan view of a tray having an active microwave energy heating element thereon for the microwavable package of FIG. 1.
Figure 3:
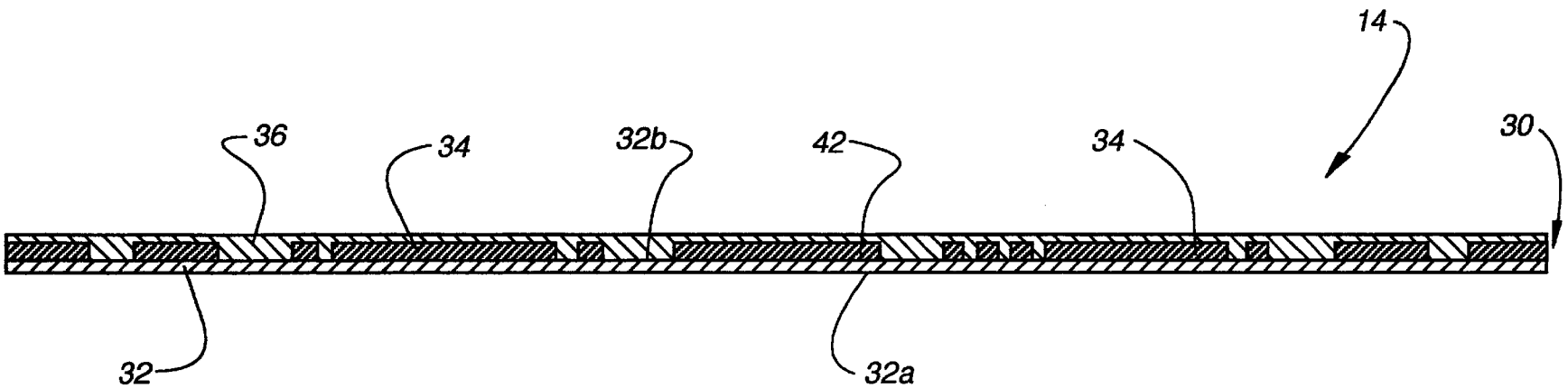
FIG. 3 is cross-sectional view of FIG. 2 taken along line 3—3.

Referring now to FIGS. 2 and 3, the active microwave energy heating element 14 is better illustrated. As is shown, the microwave energy heating element 14 is in the form of a laminate 30 and includes a substrate 32 formed of suitable material such as for example paper, paperboard or polymeric film. One surface 32*a* of the substrate is adhered to the base 12 and an opposed surface 32*b* has a pattern 34 of microwave interactive material deposited thereon. The microwave energy interactive material 34 may be electroconductive or semiconductive material such as metal foil, vacuum deposited metal or metallic ink. The electroconductive material is preferably aluminum although other metals such as copper may be employed. In addition, the electroconductive material may be replaced with a suitable electroconductive, semiconductive or non-conductive artificial dielectric or ferroelectric. Artificial dielectrics comprise conductive subdivided material in a polymeric or other suitable matrix or binder and may include flakes of electroconductive metal such as aluminum.

A susceptor 36 including at least one layer of suscepting material covers the microwave energy interactive material 34 and the substrate 32 and produces a heating effect upon excitation by incident microwave energy as is well known. The susceptor 36 may be in the form of a printed ink or alternatively, a coating sputtered or evaporated over the active element 14. The susceptor 36 may not be utilized or additional layers of suscepting material may be provided depending on the heating effect required.

The pattern of microwave energy interactive material 34 and susceptor 36 constitute a microwave energy controlling structure which permits a controlled degree of penetration of incident microwave energy through the base 12 and channels microwave energy towards a central region of the food product. Specifically, the design of the active microwave energy heating element 14 moderates penetration of microwave energy in the peripheral region of the food product 16 and directs microwave energy towards its central region. This allows the food product to cook more uniformly.

Looking at the pattern of microwave energy interactive material 34 more closely, it can be seen that the pattern includes a plurality of circumferentially spaced transmission elements 40 arranged in a ring about a circular island 42 positioned at the center of the microwave energy heating element 14. Each transmission element 40 includes a pair of resonant loops 44 interconnected by a pair of transmission lines 46. In this particular example, the loops 44 are generally circular. The loops 44 have a perimeter sufficient to limit currents induced therein to below a predetermined level and which is as close to an integer multiple of the effective wavelength of the incident microwave energy.

The loops 44 are tuned to collect microwave energy from the peripheral region of the microwave energy heating element 14 and distribute the energy to a central region of the food product to heat the food product generally uniformly and to inhibit charring of the base 12. The transmission lines 46 are selected to provide a progressive power loss from each of the tuned loops 44 and are of such length that the power decays towards zero at the mid-point of the transmission lines. This is achieved by matching the energy fed by the loops 44 to the absorption characteristics of the transmission lines 46.

Two arrays 50 and 52 of tuned structures 54 and 56 respectively are also circumferentially spaced in a ring about the circular island 42. The tuned structures 54 of array 50 are positioned between adjacent transmission elements 40 while the tuned structures 56 of the array 52 are positioned between the two loops 44 of each transmission element 40. The tuned structures 54 and 56 each include nested loops and islands as will now be described.

Each tuned structure 54 and 56 includes a deltoid ring 60 having rounded corners. Within the deltoid ring 60 is an annular ring 62 joined to opposed corners of the deltoid ring by a pair of bridges 64. A circular island 66 is positioned within the annular ring 62. A sagittal island 68 is also positioned within the deltoid ring 60. The arrowhead 70 of the sagittal island 68 points toward the center of the microwave energy heating element 14. The shaft 72 of the sagittal island 68 extends radially from the arrowhead 70 crossing the annular ring 62 and terminating at the circular island 66.

The deltoid rings 60 of the tuned structures 54 are more elongate than the deltoid rings of the other tuned structures 56 and therefore are more pointed towards the center of the microwave energy heating element 14. The arrowheads 70 of the sagittal islands 68 within the deltoid rings 60 of the tuned structures 54 are also more pointed than the arrowheads of the tuned structures 56. As a general principle, the loops and islands are reactive with the incident microwave energy and so the nature and extent of their coverage of the microwave energy heating element determines the amount and distribution of microwave energy. The radial spacing between the deltoid and annular rings is such that the enclosed circuit length is close to $\lambda$ where $\lambda$ is equal to the effective wavelength of the incident microwave energy. The islands principally inhibit transmission of microwave energy but provide a local excitation at their outer edges.

The outer-most corners of the deltoid rings 60 are joined to an outer ring 76 which covers the peripheral margin of the microwave energy heating element 14 by bridges 74. The bridges 64 and 74 permit the tuned structures 54 and 56 to be excited by the antenna formed by the inner circumference of peripheral edge 76*b*.

The outer ring 76 has a circular outer peripheral edge 76*a* and an undulating inner peripheral edge 76*b*. Two concentric rings of circumferentially spaced apertures 78 are formed in the outer ring. The apertures 78 are in the form of elongate slots having cambered major edges. In the specific embodiment shown, the elongate slots 78 of the two rows are staggered.

Figure 4:
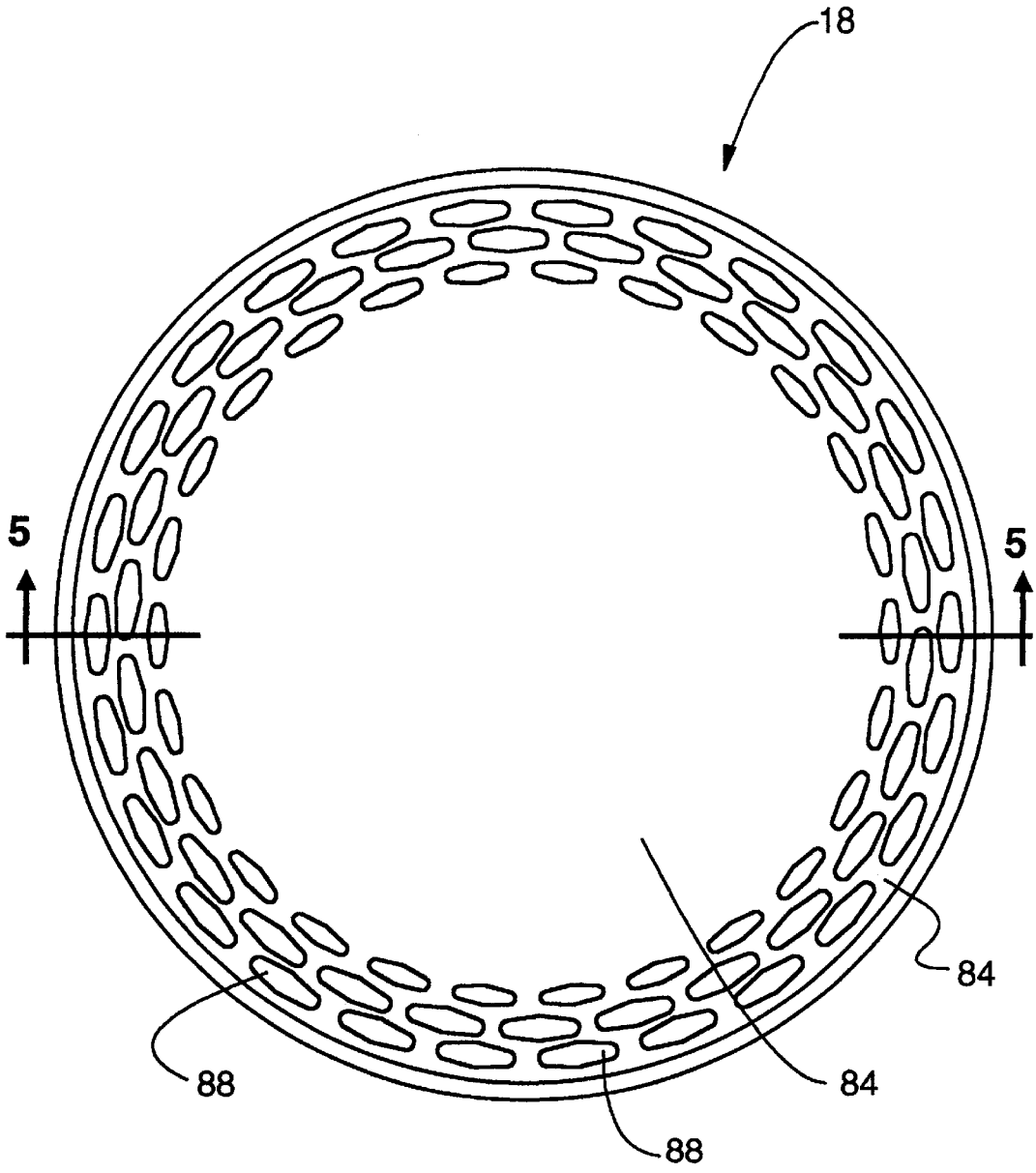
FIG. 4 is a top plan view of a cover forming part of the microwavable package of FIG. 1.
Figure 5:
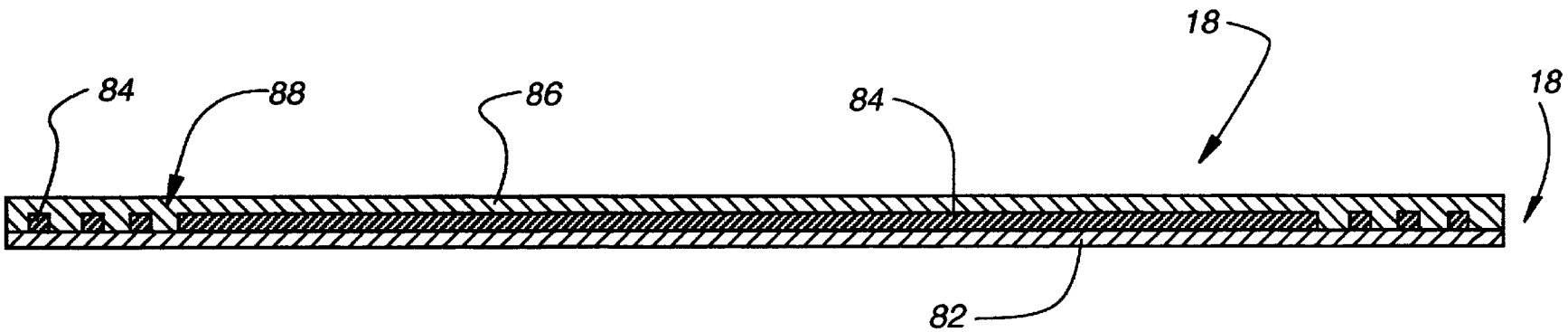
FIG. 5 is a cross-sectional view of FIG. 4 taken along line 5—5.

Referring now to FIGS. 4 and 5, the cover 18 is better illustrated. The circular cover 18 is also in the form of a laminate 80 and includes a substrate 82 formed of suitable material such as for example, paper, paperboard or a polymeric film. Microwave energy interactive material 84 of one of the types previously described is on one surface of the substrate 82. A susceptor 86 including at least one layer of suscepting material overlies the microwave energy interactive material 84 and the substrate 82 although the susceptor 86 is optional. The substrate 82 extends beyond the peripheral edge of the microwave energy interactive material 84 to ensure that the cover 18 and the microwave energy heating element 14 remain electrically isolated if the edge of the cover 18 contacts the microwave energy heating element. Spaced apertures 88 are formed in the microwave energy interactive material 84 about its peripheral margin. The apertures 88 are in the form of elongate slots having cambered major edges. In the particular example shown, the slots are arranged in three concentric rings with the slots in the various rings being staggered. The elongate slots 88 are sized to promote localized fields to enhance the susceptor 86 and promote browning of the food product 16 when penetrated by microwave energy. In addition, the circumference of the shielding may be designed to enhance or limit the electrical activity at its edge.

During packaging, the food product 16 is placed on the microwave energy heating element 14 and is supported by the base 12. The flexible cover 18 is then placed over top the food product 16 with the susceptor 86 in contact with the food product. Since the cover 18 is flexible it generally conforms to the shape of the food product. Following this, the base 12, cover 18 and food product 16 are shrink wrapped with the plastic film 20 to hold securely the food product 16 between the base 12 and the cover 18 and inhibit relative movement between them. Because the wrap 20 holds the cover, base and food product securely, in the case of pizzas, separation between the crust and the pizza toppings is unlikely to occur.

When the food product 16 is to be cooked, the wrap 20 is removed and the food product 16 is placed in the microwave oven supported by the base 12 and with the cover 18 overlying the top of the food product. The outer edge of the cover 18 is preferably folded down over at least a portion of the sidewall of the food product to provide some edge heating. The design of the microwave energy heating element 14 and cover 18 are such to heat uniformly the food product 16 while ensuring that the crust of the food product is cooked and browned.

Although the cover 18 is shown as being circular and planar, the cover can take other geometric shapes and may be in the form of a dome to overlie the top of the food product 16 as well as its sides.

Figure 7:
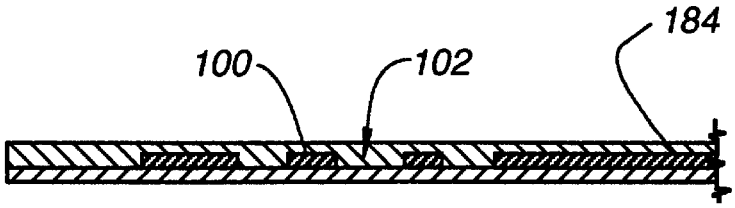
FIG. 7 is an enlarged part cross-sectional view of FIG. 6 taken along line 7—7.
Figure 8:
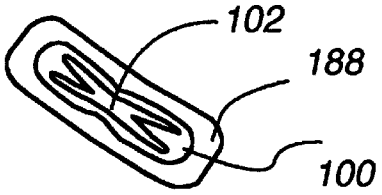
FIG. 8 is an enlarged top plan view of a portion of FIG. 6.

Referring now to FIGS. 7 and 8, another embodiment of a cover for a microwavable package is shown. In this embodiment, two concentric rings of apertures 188 are formed in the peripheral margin of the microwave energy interactive material 184. The apertures in this case are rectangular in appearance and have rounded corners. Islands 100 are located within each aperture 188. Each island 100 itself has a flattened decussate aperture 102 formed in it.

Although, the cover 18 has been described as being flexible to allow it to be folded over at least a portion of the sides of the food product 16, those of skill in the art will appreciate that the peripheral margin of the base 12 may also be made to be flexible so that the active microwave energy heating element 14 may be folded over at least a portion of the side of the food product together with or instead of the cover 18. In these instances, the cover 18 and base 12 should be dimensioned to inhibit electrical coupling of the microwave energy interactive material on the cover and base.

In addition, although the microwave energy heating element and cover have been described as a laminate with the microwave energy interactive material deposited on one surface of the substrate and covered by a susceptor, it should be realized that the pattern of microwave energy interactive material can be deposited on one surface of the substrate and the susceptor can be deposited on an opposite surface of the substrate. In this case, the surface of the substrate on which the microwave energy interactive material is deposited, is bonded or adhered to the base 12.

Figure 9:
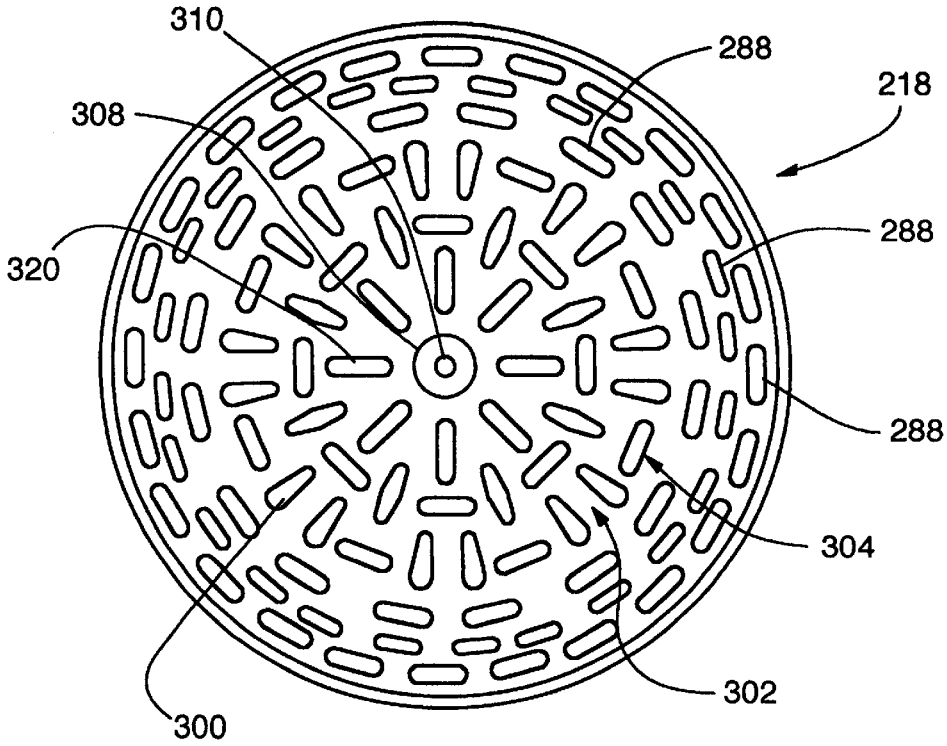
FIG. 9 is a top plan view of yet another alternative embodiment of a cover for a microwavable package in accordance with the present invention.

Referring now to FIG. 9, yet another embodiment of a cover 218 for a microwavable package is shown. In this embodiment, three concentric rings of apertures 288 are formed about the peripheral margin of the microwave energy interactive material 284. The apertures 288 are in the form of elongate slots and are arranged so that the apertures of the various rings are staggered. Within the inner most ring of apertures 288, is an array of additional apertures 300. The apertures 300 are in the form of elongate slots and are arranged in two alternating patterns 302, 304 about the center of the cover 218. Each pattern 302 of apertures 300 includes three radially directed apertures arranged to form a triangle with a tangentially oriented aperture between the inner aperture and the two outer apertures. The apertures that are arranged to form a triangle taper in width towards the center of the cover 218. Each pattern 304 of apertures 300 includes an outer tangentially oriented aperture and an inner radially directed aperture 300. The radially directed aperture has cambered major edges. An annular aperture 308 is formed at the center of the cover and surrounds a circular island 310.

Depending upon the depth of the crust, the toppings appearance and design on the crust and the size of the pizza, a cover of the types illustrated may or may not be used. Although the cover will assist heating of the food product, due to cost in many applications, a transparent cover or no cover will be used.

Figure 6:
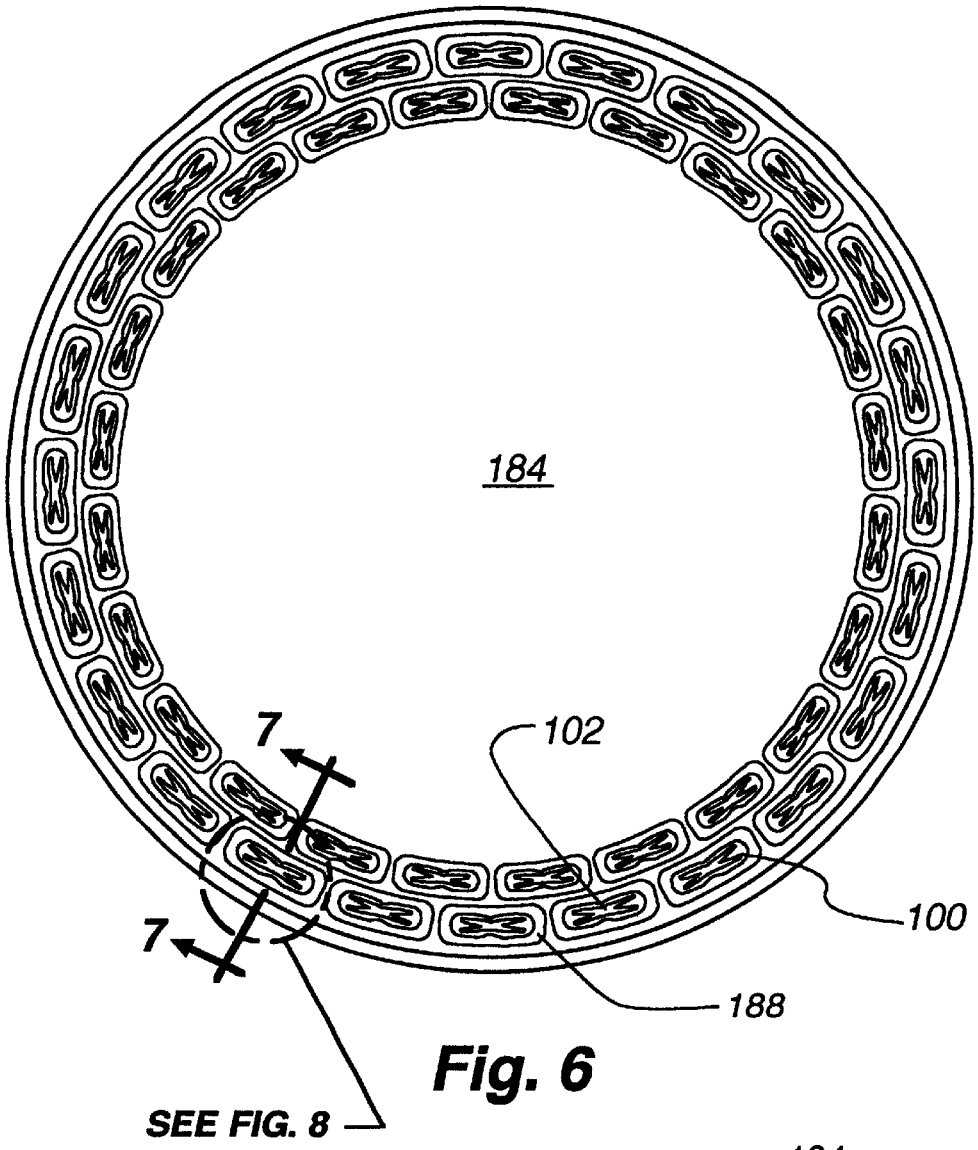
FIG. 6 is a top plan view of an alternative embodiment of a cover for a microwavable package in accordance with the present invention.

Although FIGS. 4, 6 and 9 illustrate different embodiments of the cover, those of skill in the art will appreciate that other configurations of microwave energy interactive material on the cover can be used. For example, the cover may include islands of microwave energy interactive material in the shape of circles or polygons. Alternatively, the microwave energy interactive material may include annular or polygonal loops surrounding correspondingly shaped islands.

Figure 10:
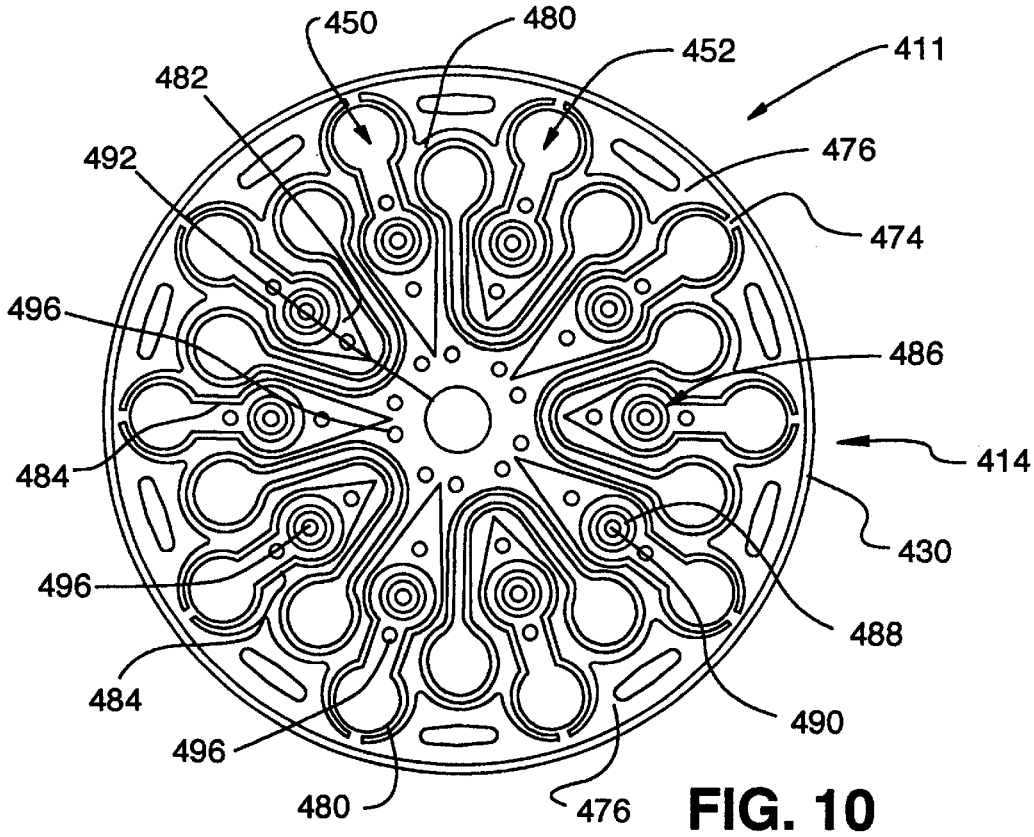
FIG. 10 is a top plan view of an alternative embodiment of a tray having an active microwave energy heating element thereon for a microwavable package in accordance with the present invention.

Referring now to FIG. 10, another embodiment of a tray 411 is shown. In this embodiment, the configuration of the tuned structures 450 and 452 and the outer peripheral ring 476 is different from that of FIG. 2. As can be seen, each tuned structure 450 and 452 includes a generally circular loop 480 joined to the outer ring 476 by a bridge 474. The loop 480 is connected to a triangular island 482 by way of a pair of transmission lines 484. Nested loops 486 are positioned between the transmission lines 484 adjacent the triangular islands 482 and include an annular ring 488 surrounding a circular island 490. The triangular islands 482 of the tuned structures 450 are longer than those of tuned structures 452 and point towards a circular island 492 at the center of the tray. Three concentric rings of apertures 496 are provided through the tray 411. The apertures 496 allow moisture released from the food product during cooking to pass through the tray 411. In use, a moisture absorbing towel or the like will typically be placed beneath the tray to absorb moisture passing through the apertures 496. The substrate 430 extends beyond the peripheral edge of the active heating element 414.

Figure 11:
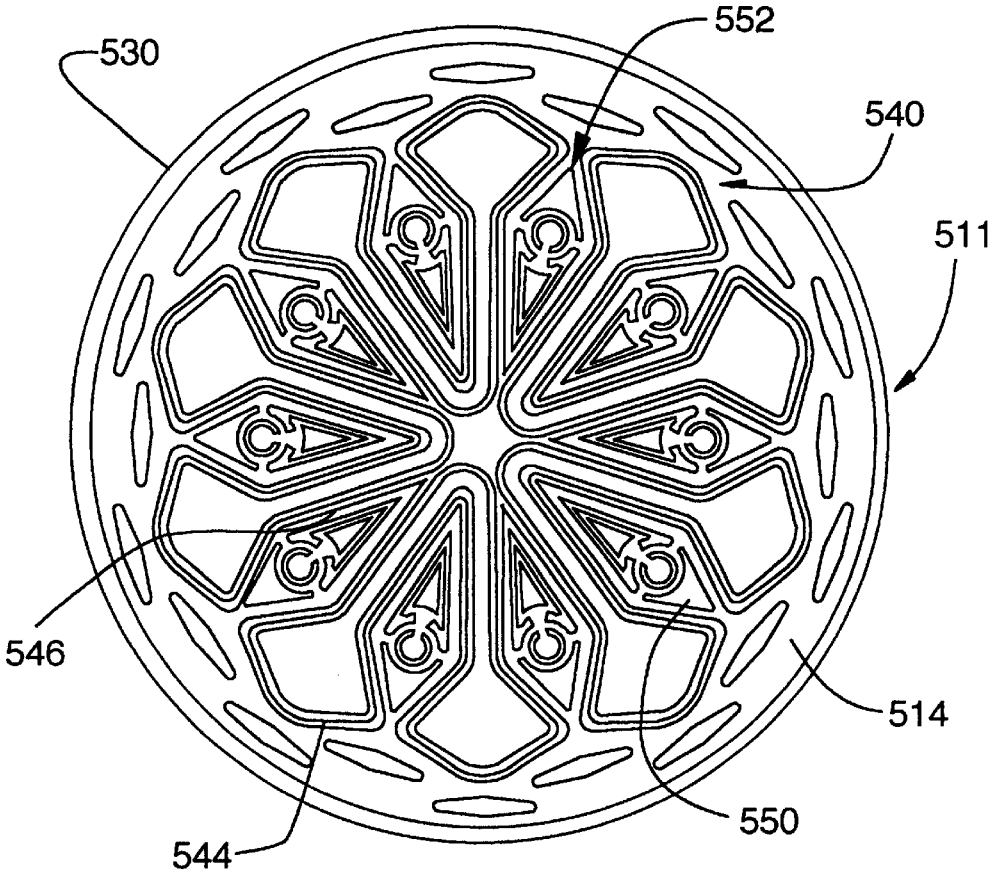
FIG. 11 is a top plan view of another alternative embodiment of a tray having an active microwave energy heating element thereon for a microwavable package in accordance with the present invention.

Referring now to FIG. 11, another embodiment of a tray 511 is shown. Tray 511 is very similar to that shown in FIG. 2. As can be seen, the active microwave energy heating element 514 includes a plurality of circumferentially spaced transmission elements 540 arranged in a ring about the center of the tray. An array of tuned structures 550 and 552 are also circumferentially spaced in a ring about the center of the tray. Tuned structures 550 are positioned between adjacent transmission elements 540 while tuned structures 552 are positioned between the loops 544 of each transmission element 540. In this case, the tuned structures 550 and 552 are the same. Unlike the embodiment of FIG. 2, the tray 511 does not include an island at its center. However, the transmission lines 546 are longer and extend closer to the center of the tray. The loops 544 are generally diamond-shaped with rounded corners and the tuned structures 550 and 552 are more elongate and have sharper corners. Also, the substrate 530 extends beyond the peripheral edge of the active heating element 514.

Figure 12:
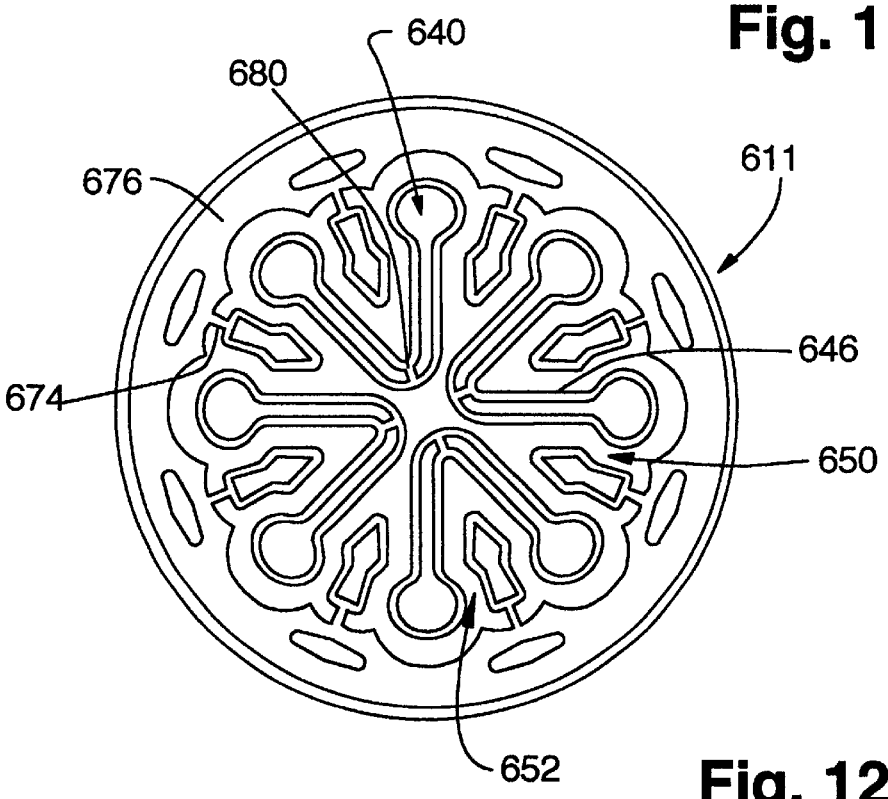
FIG. 12 is a top plan view of yet another alternative embodiment of a tray having an active microwave energy heating element thereon for a microwavable package in accordance with the present invention.

FIG. 12 shows yet another embodiment of a tray 611. In this embodiment, the transmission lines 646 extend closer to the center of the tray obviating the need for an island at the center. Also, a bridge 680 joins the transmission lines 646 of each transmission element 640 at their mid-point. The tuned structures 650 and 652 are the same and are in the form of loops resembling arrowheads. The tuned structures 650 and 652 are joined to the outer ring 676 by bridges 674.

Figure 13A:
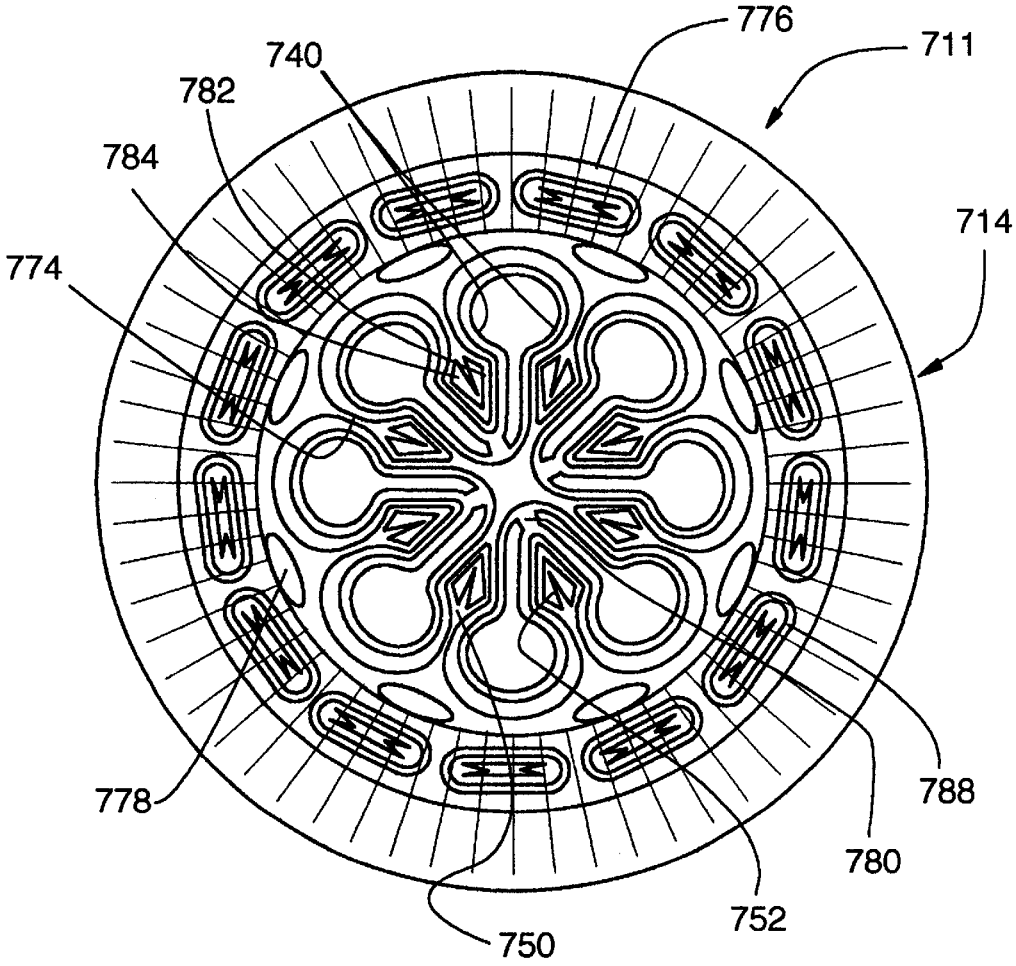
FIG. 13*a* is a top plan view of still yet another alternative embodiment of a tray having an active microwave energy heating element thereon for a microwavable package in accordance with the present invention.
Figure 13B:
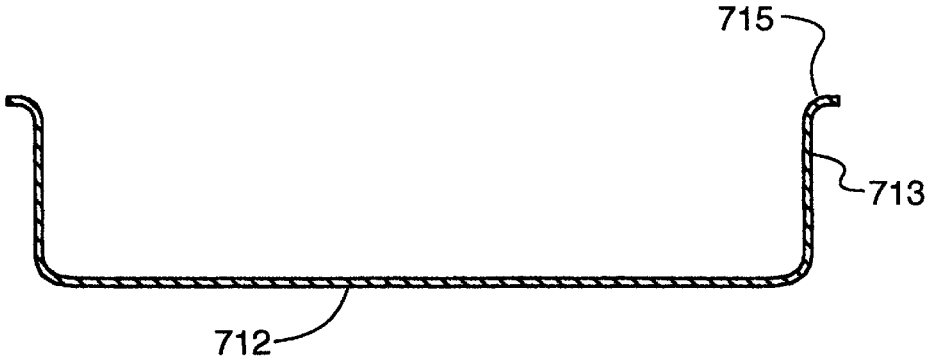
FIG. 13*b* is a cross-sectional view of FIG. 13*a*.

Referring now to FIGS. 13*a* and 13*b*, yet another embodiment of a tray 711 is shown. In this embodiment, tray 711 includes a base 712, and upstanding sidewall 713 about the periphery of the base 712 and a peripheral rim 715 about the sidewall. The active heating element 714 extends over the base and the sidewall 713. The transmission elements 740 and tuned structures 750 and 752 are on the base 712 while the outer ring 776 runs about the periphery of the base and over the sidewall 713. As can be seen, similar to the previous embodiment, bridges 780 join the transmission lines 746 at their mid-points. The tuned structures 750 and 752 are the same and are in the form of diamond-shaped loops 782 joined to the outer ring 776 by narrow bridges 774. A triangular projection 784 extends into each loop 782. A ring of apertures 778 is formed in the outer ring 776 about the periphery of the base. A ring of apertures 788 similar to those provided in the cover of FIG. 6 are formed in the outer ring about the circumference of the sidewall.

In each of the embodiments of FIGS. 10 to 13*b* and similar to the embodiment of FIG. 2, the active microwave heating element on the tray collects microwave energy from the periphery of the tray and dissipates it progressively towards the center of the tray to provide a uniform heating effect.

While the above described embodiments show a tray and cover separate from the tray, the active microwave energy heating elements may be provided on opposed surfaces of a bag or pouch designed to accommodate the food product.

Although particular embodiments of the microwave energy heating element 14 have been described and shown it should be apparent to those of skill in the art that other patterns of microwave energy interactive material may be provided on the microwave energy heating element to achieve the desired uniform heating of the food product. Examples of alternative patterns of microwave energy interactive material designed to heat uniformly a food product upon exposure to incident microwave energy can be found in applicant's co-pending application filed on Sep. 18, 1995 and issued serial number 08/529,450.

Also, although the tray 411 has been shown to include apertures 496 therein to allow moisture to pass through the tray, those of skill in the art will appreciate that the other embodiments of the trays may also include apertures. In addition, apertures may be provided through the covers if desired to allow moisture to pass.

Those of skill in the art will also appreciate that variations and modifications may be made to the present invention without departing from the spirit and scope thereof as defined by the appended claims.

What is claimed is:

1. A microwavable package comprising:

a base to support a food product;

an active microwave energy heating element on said base to effect heating of a food product upon impingement by microwave energy; and a cover spaced apart from said active microwave energy heating element to overlie said food product, said cover including a microwave energy interactive material layer extending substantially over said food product, said microwave energy interactive material including a plurality of apertures spaced about said cover, said apertures being sized to promote localized fields to promote browning of said food product.

2. A microwavable package as defined in claim 1 wherein said apertures are in the form of elongate slots.

3. A microwavable package as defined in claim 2 wherein said elongate slots are arranged in concentric rings.

4. A microwavable package as defined in claim 3 wherein said rings are circular.

5. A microwavable package as defined in claim 4 wherein the slots in said concentric rings are staggered.

6. A microwavable package as defined in claim 5 further including at least one layer of suscepting material on said cover and overlying said microwave energy interactive material.

7. A microwavable package as defined in claim 2 wherein microwave energy interactive material islands are located within said elongate slots.

8. A microwavable package as defined in claim 7 wherein said elongate slots are arranged in concentric rings.

9. A microwavable package as defined in claim 8 wherein said rings are circular.

10. A microwavable package as defined in claim 9 wherein the slots in said concentric rings are staggered.

11. A microwavable package as defined in claim 7 wherein each of said microwave energy interactive material islands has an aperture formed therein.

12. A microwavable package as defined in claim 11 wherein said apertures are substantially decussate.

13. A microwavable package as defined in claim 1 wherein said active microwave energy heating element includes a plurality of energy collecting structures, each of said energy collecting structures including resonant loops having a perimeter sufficient to limit currents induced therein to below a predetermined level upon impingement by incident microwave energy, said energy collecting structures distributing energy towards a central region of said food product to uniformly heat said food product and to inhibit charring of said base.

14. A microwave package as defined in claim 13 wherein said energy collecting structures include a pair of resonant loops interconnected by transmission lines, said transmission lines configured to provide a progressive power loss between said resonant loops.

15. A microwavable package as defined in claim 14 wherein the perimeter of said resonant loops and the length of each of said transmission lines are substantially equal to an integer multiple of the effective wavelength of said incident microwave energy projected onto said microwave energy heating element.

16. A microwavable package as defined in claim 15 wherein said resonant loops are circular.

17. A microwavable package as defined in claim 16 wherein said energy collecting structures are circumferentially spaced and arranged in a ring about the center of said active element.

18. A microwavable package as defined in claim 17 wherein said active microwave energy heating element further includes a plurality of tuned structures at spaced locations and positioned between adjacent resonant loops.

19. A microwavable package as defined in claim 18 wherein said tuned structures include nested loops.

20. A microwavable package as defined in claim 19 wherein said nested loops are joined by bridges.

21. A microwavable package as defined in claim 1 further including a plurality of spaced apertures provided through said base and active microwave energy heating element to allow moisture released from said food product to pass.

22. A microwavable package as defined in claim 21 wherein said apertures are arranged in concentric rings.

23. A microwavable package comprising:

a base to support a food product;

an active microwave energy heating element interposed between said food product and said base to effect heating of said food product upon impingement by microwave energy;

a cover spaced apart from said active microwave energy heating element to overlie said food product, said cover comprising:

microwave energy interactive material covering at least a portion of said food product, said microwave energy interactive material containing a plurality of apertures spaced about said cover;

a substrate supporting and extending beyond the peripheral edge of said microwave energy interactive material to isolate electrically said base and said cover; and at least one layer of suscepting material interposed between said food product and said microwave energy interactive material;

wherein said apertures are sized to promote a localized fields to locally enhance said at least one layer of suscepting material and promote browning of said food product.

24. A microwavable package as defined in claim 23 wherein said microwave energy interactive material extends substantially over said food product.

25. A microwavable package as defined in claim 24 wherein said apertures are in the form of elongate slots.

26. A microwavable package as defined in claim 25 wherein said elongate slots are arranged in concentric circular rings, the slots in adjacent concentric rings being staggered.

27. A microwavable package as defined in claim 26 wherein microwave energy interactive material islands are located within said elongate slots.

28. A microwavable package as defined in claim 27 wherein said elongate slots are arranged in concentric circular rings, the slots in adjacent concentric rings being staggered.

29. A microwavable package as defined in claim 28 wherein each of said microwave energy interactive material islands has an aperture formed therein.

30. A microwavable package as defined in claim 29 wherein said apertures are generally decussate.

31. A microwavable package as defined in claim 23 wherein said base and active microwave energy heating element further include a plurality of spaced venting apertures to allow moisture released from said food product to pass.

32. A microwavable package as defined in claim 31 wherein said venting apertures are arranged in concentric rings.

33. A microwavable package as defined in claim 23 wherein said cover is flexible to overlie and conform to said food product, and further comprising a flexible wrap to constrain said base and cover and inhibit relative movement there between.

34. A microwavable package as defined in claim 33 wherein said base and cover are generally circular.

35. A microwavable package as defined in claim 33 wherein said food product is in the form of a pizza.

36. A microwavable package as defined in claim 1 further comprising:

a tray comprising said base and including a plurality of spaced apertures in said tray to permit moisture released from a food product to pass through said tray.

37. A microwavable package as defined in claim 36 wherein said apertures are arranged in concentric rings.

38. A microwavable package as defined in claim 1 wherein the apertures are spaced about a peripheral margin of said cover.

39. A microwavable package as defined in claim 23 wherein the apertures are spaced about a peripheral margin of said cover.

* * * * *